US005918711A

United States Patent [19]

Godshaw

[11] Patent Number: 5,918,711

[45] Date of Patent: Jul. 6, 1999

[54] STORAGE AND TRAVEL BAG

[75] Inventor: Donald Godshaw, Evanston, Ill.

[73] Assignee: Travel Caddy, Inc., Des Plaines, Ill.

[21] Appl. No.: 08/953,733

[22] Filed: Oct. 20, 1997

[51] Int. Cl.[6] ..... A45C 7/00; A45C 13/10

[52] U.S. Cl. ..... 190/107; 190/111; 190/112; 190/901

[58] Field of Search ..... 190/107, 111, 190/102, 112, 901, 103; 383/4

[56] References Cited

U.S. PATENT DOCUMENTS

| | | | |
|---|---|---|---|
| 2,170,379 | 8/1939 | Ortt | 190/107 |
| 2,244,887 | 6/1941 | Manley | 190/107 X |
| 2,254,578 | 9/1941 | O'Brien | 190/107 |
| 3,041,638 | 7/1962 | Lo Vico | 190/901 X |
| 3,173,465 | 3/1965 | Pastini | 190/107 X |
| 3,777,862 | 12/1973 | Zipper | 190/107 |
| 3,994,372 | 11/1976 | Geller et al. | 190/107 |
| 4,489,815 | 12/1984 | Martinez et al. | 190/107 X |
| 4,588,056 | 5/1986 | Bernbaum | 190/107 |
| 4,598,802 | 7/1986 | Abenaim | 190/107 |
| 4,925,021 | 5/1990 | Pulichino, Jr. | 190/112 X |
| 5,413,198 | 5/1995 | Ferris | 190/107 X |
| 5,566,797 | 10/1996 | Van Himbeeck | 190/107 X |

FOREIGN PATENT DOCUMENTS

| | | | |
|---|---|---|---|
| 28323 | 8/1931 | Australia | 190/102 |
| 4100055 | 7/1992 | Germany | 190/111 |
| 5130910 | 5/1993 | Japan | 383/4 |
| 9321793 | 11/1993 | WIPO | 190/111 |

*Primary Examiner*—Sue A. Weaver
*Attorney, Agent, or Firm*—Banner & Witcoff, Ltd.

[57] ABSTRACT

A travel and storage bag is described herein having two side sections releasably fastened to an intermediate center section to form the bag into a travel bag. Unfastening the side sections from of the center section allows the center section to be stored, reveals pockets and compartments, and allows the bag to be used as an organizer.

7 Claims, 3 Drawing Sheets

FIG. 1
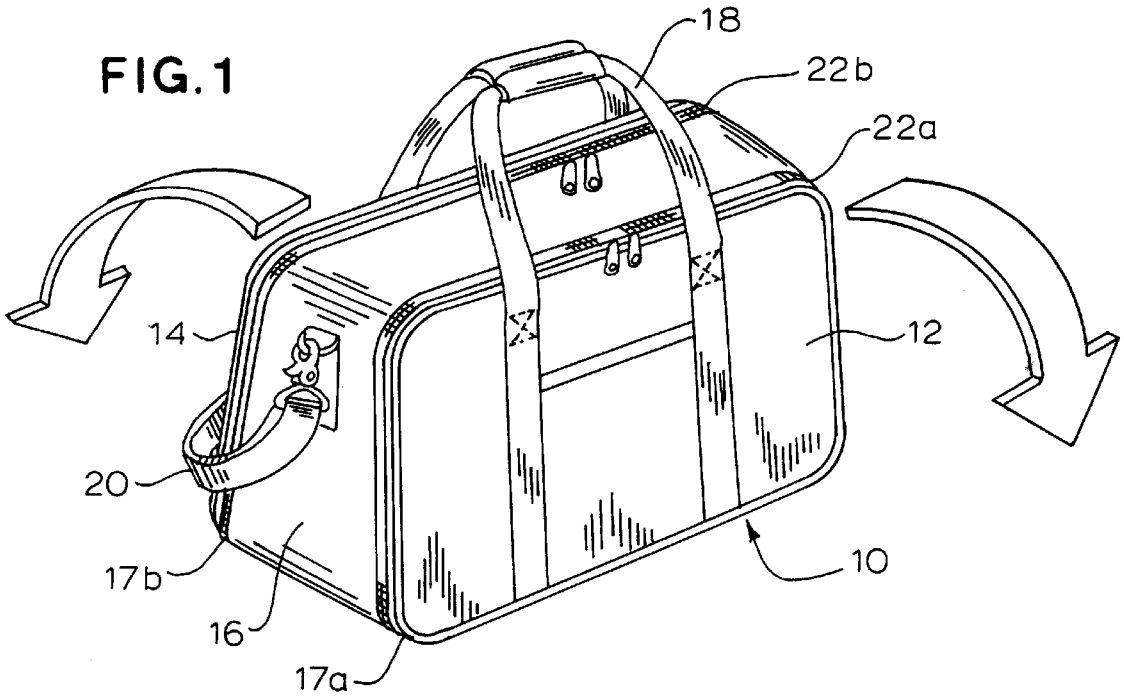
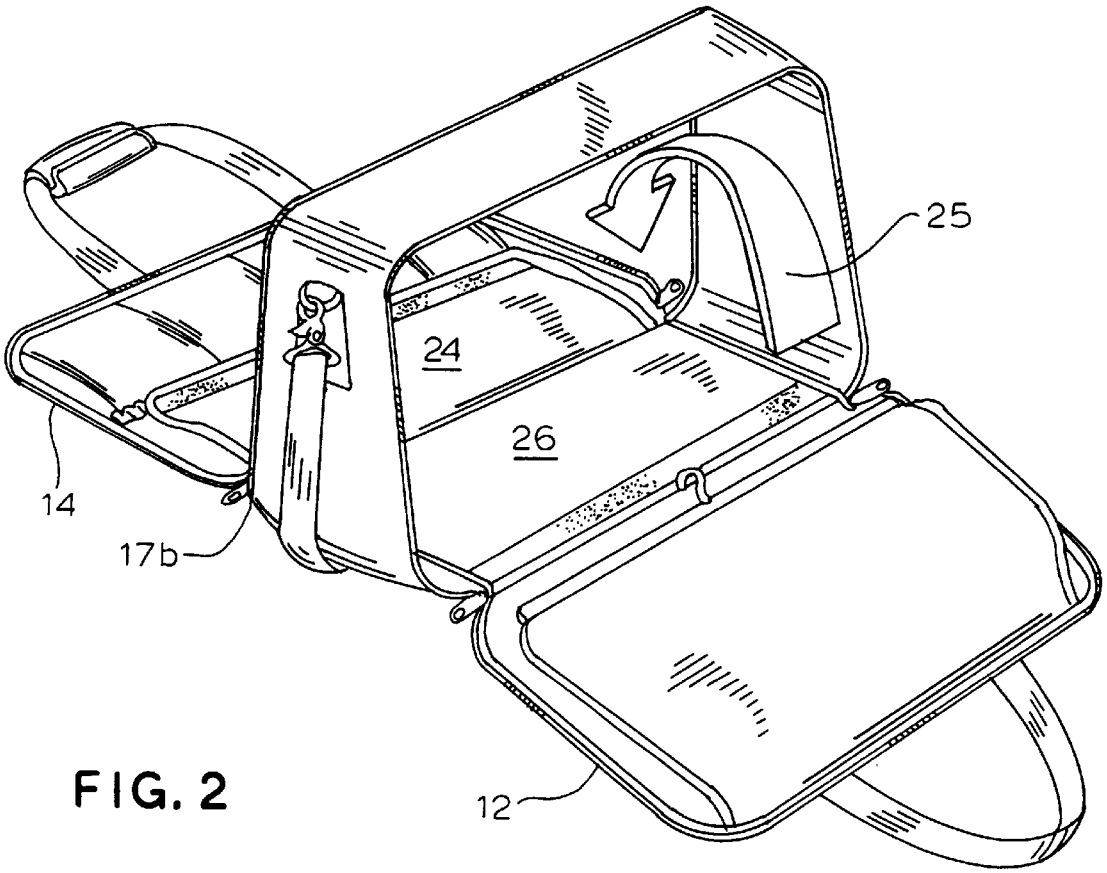
FIG. 2

STORAGE AND TRAVEL BAG

BACKGROUND OF THE INVENTION

1. Field of the Invention

The present invention relates generally to luggage or bags used for storage and travel, and more particularly relates to an innovation which facilitates the conversion of such a bag for use as a hanging organizer.

2. Description of the Prior Art

Previously, travel bags have generally exhibited a box style and their use, especially regarding access to articles within, has been accordingly limited. However, when traveling it is often desirable to organize one's belongings and to present them in an accessible manner, yet no item of luggage, and particularly a box style travel bag, has successfully achieved a design which readily converts to an effective organizer.

SUMMARY OF THE INVENTION

Accordingly, it is the principal objective of this invention to provide a travel bag which opens fully and converts into an effective hanging organizer. It is a further object to provide a collapsible center section of the bag that stores out of the way when the bag is used as an organizer.

These and other objectives are accomplished by a bag of a generally box style, having a center section and two side sections, and which is outfitted with a plurality of pockets and compartments therein. Zipper closures fasten the side sections to the center section to form the bag, when used as a travel bag. Unfastening of the sides allows the center section to fold and store under a flap, to allow unrestricted access to the pockets and compartments of the bag (which now presents itself as an organizer).

BRIEF DESCRIPTION OF THE DRAWINGS

FIG. 1 is a perspective view of a travel bag in accordance with the present invention.

FIG. 2 is a perspective view of the travel bag of FIG. 1 with its end sections opened.

Figure 3:
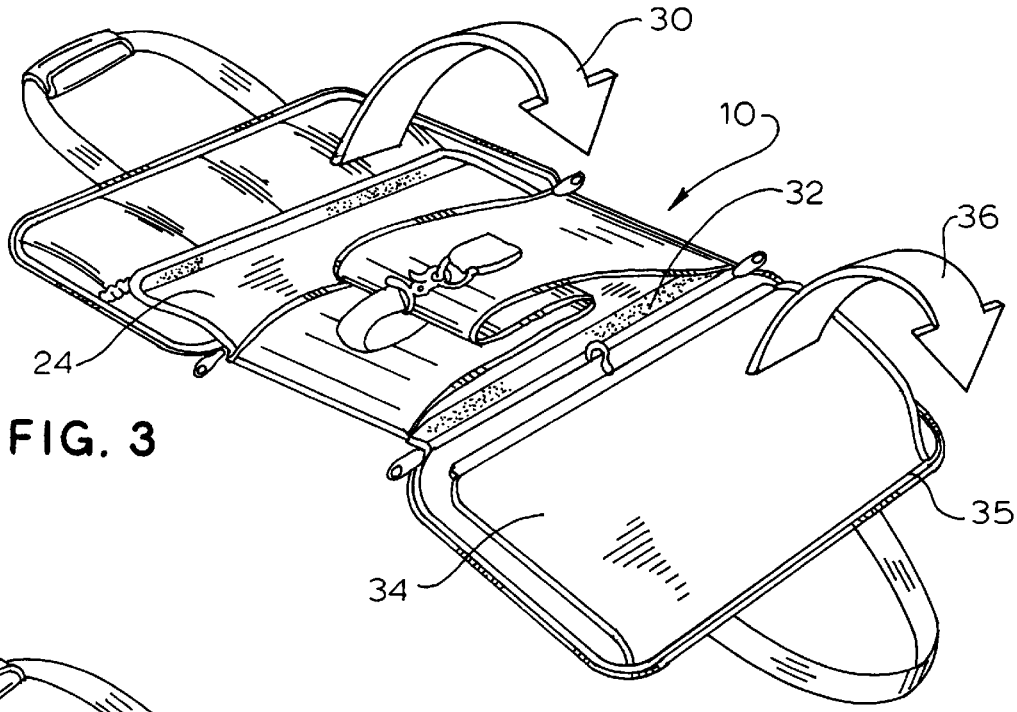
FIG. 3 is a perspective view of the bag of FIGS. 1 and 2 showing the collapse of the center section and closing of the storage flap over the center section.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Turning first to FIG. 1 there is shown a travel bag in accordance with the present invention. This bag presents an enclosure having a rectangular base member 10 and formed by three sections: a first side section 12, a second side section 14 and a center section 16 intermediate said side sections. The center section and each of the side sections are hinged or otherwise flexibly attached to the base member along the bottom edges 17*a* and 17*b*. Attached to the side sections are handles 18 and attached to the center section is a shoulder strap 20, both to facilitate carrying of the bag.

Holding the two side sections to the center section are fastener means 22*a* and 22*b*, in the form of zippers or the like. When unfastened (FIG. 2) the side sections open to lie flat, leaving a hollow center section and exposing a center control member, such as flap 24, shown opened (arrow 25) and available to cover a central area 26.

Figure 4:
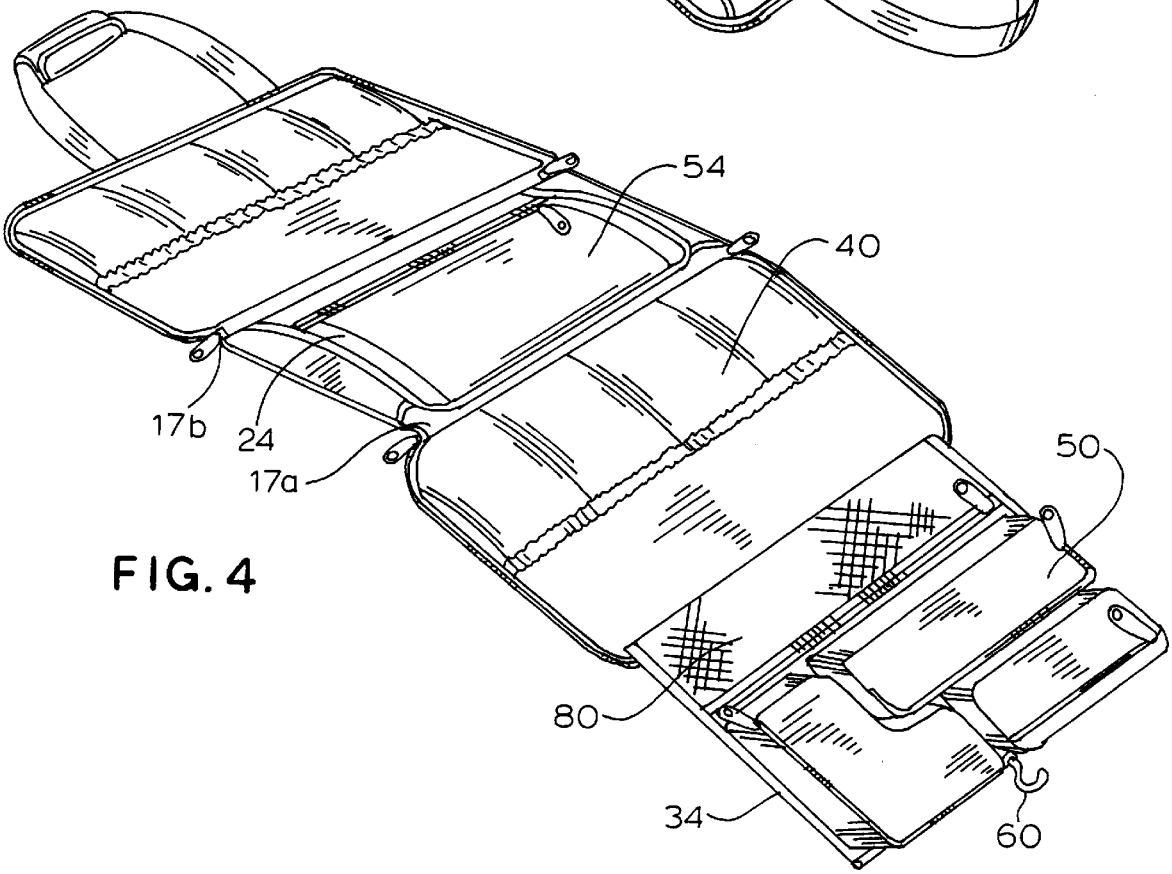
FIG. 4 is a perspective view of the bag of FIGS. 1–3 revealing an additional organizer compartment area.
Figure 5:
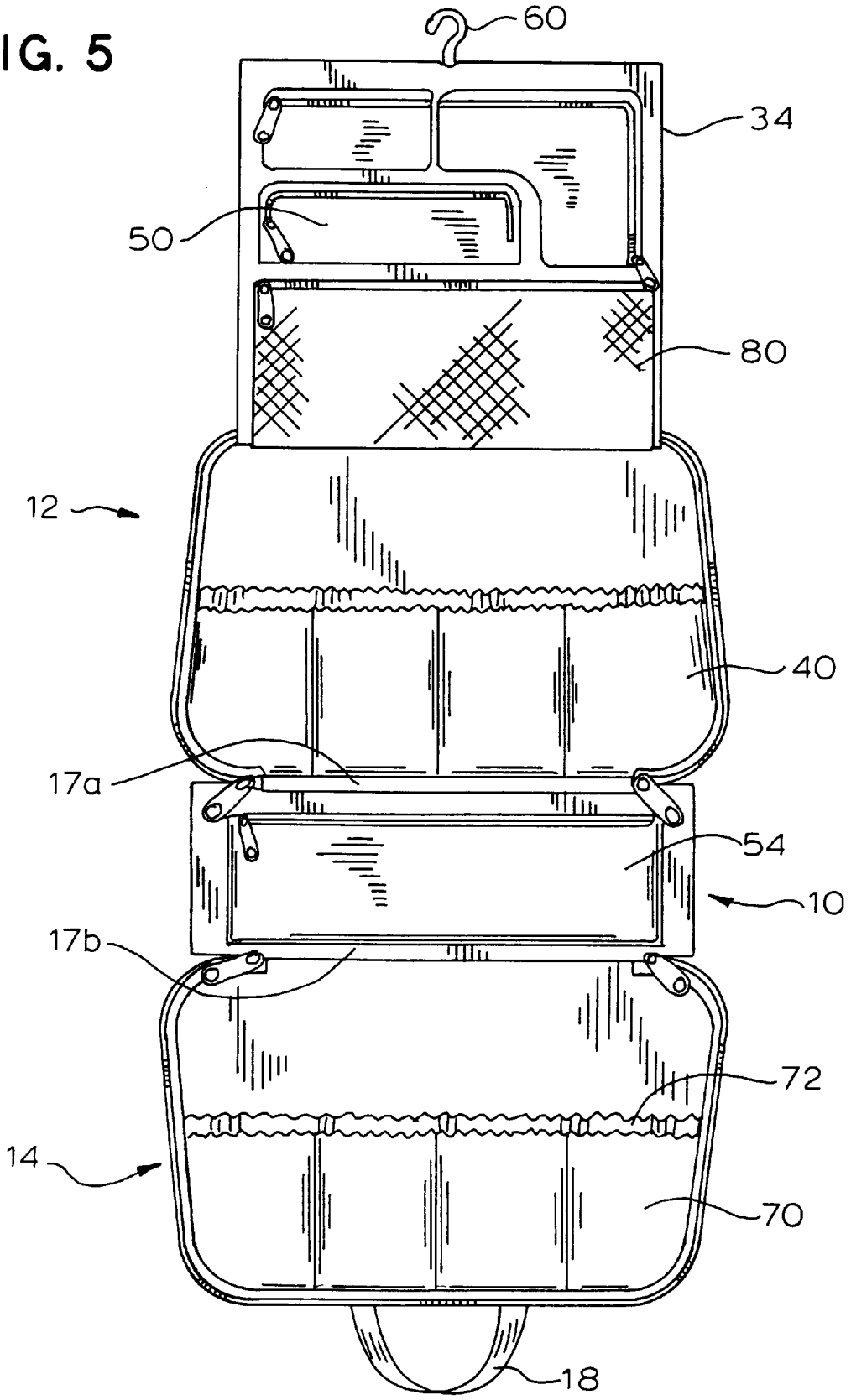
FIG. 5 is a plan view of the bag/organizer of FIG. 4.

As shown in FIG. 3, the upper portion of the center section 16 can now be collapsed and folded within the central area 26, allowing the flap 24 to be replaced over the center section, as depicted by the arrow 30. With the flap now covering the center section, fastening or trapping means 32, such as a hook/loop fastener, zipper or the like, is employed to hold the flap, and the folded center section thereunder, in place. Additionally, secondary side members 34 which are hinged, or otherwise flexibly attached, to the upper edge 35 of the side sections can now be unfolded (arrow 36) to expose additional organizer features (see FIG. 4).

Numerous and various storage means and organizing features in the form of pockets 40 and compartments 50, including a compartment 54 on the flap 24, are provided within the travel bag along the inside surfaces of the side sections 12 and 14 and on the surfaces of the secondary side members 34 to facilitate storage and organization. With the upper portion of the center section now stored out of the way, the bag can be used effectively as an organizer, either lying flat or hanging from a hook 60 located at one end of the bag/organizer.

In a further feature there are provided pockets 40 and 70 located on the side sections, each having elastic closures 72 at the opening of each pocket, such that each pocket is particularly adapted to receive and store shoes. In yet a further feature, there is provided at least one compartment 80 formed or attached to a side section, or to a secondary side member, and presenting at least one side composed of a mesh material to allow air to circulate therethrough.

From the foregoing description, it will be apparent that modifications can be made to the apparatus and method for using same without departing from the teachings of the present invention. Accordingly, the scope of the invention is only to be limited as necessitated by the accompanying claims.

What is claimed is:

1. A storage and travel bag comprising, in combination:

a base member of substantially rectangular shape with a first edge and a second opposite side edge;

a first side section hingedly attached to said base member along said first edge thereof;

a second side section hingedly attached to said base member along said second edge thereof in opposition to said first side section, said base member further including a center section loop of foldable material defining opposite side portions and an upper portion of the bag;

separate first and second fastening means along said first and second side sections for joining said respective side sections to said center section loop including the side portions and the upper portion to thereby open and close the bag, said center section loop foldable against the base, said first and second side sections positionable in the plane of the base for access to the contents of the bag when side sections are not joined to the loop and the bag is open;

trapping means for holding the folded center loop section on the base member; and a hook element on one of the first or second side sections to support the open bag by hanging with one side section vertically above the other and separated by the base member.

2. The storage and travel bag of claim 1 wherein said means for holding said center section in said collapsed position comprises a superposed trapping member releasably attached to said base section.

3. The storage and travel bag of claim 2 wherein said trapping member is hinged to said base member along a first edge and releasably attached to said base member along a second edge.

4. The storage and travel bag of claim 3 wherein said trapping member is releasably attached by hook/loop fastener means.

5. The storage and travel bag of claim 1 further comprising a secondary side member hingedly connected to said first side section for providing additional compartments.

6. The storage and travel bag of claim 5 further comprising a compartment attached to said secondary side member having at least one side thereof formed of a mesh material.

7. The storage and travel bag of claim 1 further comprising a plurality of pockets and compartments affixed along said first and second side sections.

* * * * *